United States Patent [19]

Van Brocklin

[11] Patent Number: 4,606,479

[45] Date of Patent: Aug. 19, 1986

[54] PUMP FOR DISPENSING LIQUID FROM A CONTAINER

[75] Inventor: Owen F. Van Brocklin, Bristol, Conn.

[73] Assignee: Risdon Corporation, Naugatuck, Conn.

[21] Appl. No.: 600,428

[22] Filed: Apr. 16, 1984

[51] Int. Cl.[4] ..... B67D 5/42

[52] U.S. Cl. ..... 222/321; 222/380; 222/385; 239/333

[58] Field of Search ..... 222/321, 383, 380, 385; 239/333, 331, 329

[56] References Cited

U.S. PATENT DOCUMENTS

| | | | |
|---|---|---|---|
| 2,362,080 | 11/1944 | Martin | 239/333 |
| 4,025,046 | 5/1977 | Boris | 222/321 |
| 4,122,982 | 10/1978 | Giuffredi | 222/263 |
| 4,173,297 | 11/1979 | Pettersen | 222/385 |
| 4,212,332 | 7/1980 | Kutik et al. | 222/332 |
| 4,230,242 | 10/1980 | Meshberg | 222/321 |
| 4,271,990 | 6/1981 | Kutik et al. | 222/321 |
| 4,278,189 | 7/1981 | Kirk, Jr. | 222/321 |
| 4,317,531 | 3/1982 | Saito et al. | 222/321 |

*Primary Examiner*—Joseph J. Rolla
*Assistant Examiner*—Louise S. Heim
*Attorney, Agent, or Firm*—St. Onge Steward Johnston & Reens

[57] ABSTRACT

A pump for dispensing liquid from a container is disclosed and comprised a cylinder, and a piston having an interior chamber with a valve member disposed therein, the valve member having a cylindrical surface at one end portion thereof. An inlet valve is provided and includes a sleeve having a cylindrical surface having a diameter sized to frictionally engage, provide a liquid seal and slide with respect to the cylindrical surface of the valve member. The inlet valve sleeve seats upon an annular ring extending around the inlet opening of the cylinder and seals the interior chamber of the pump with respect to the container. In accordance with an aspect of the invention, the pump may be non-venting such that a vacuum builds in the container as liquid is dispensed, and a sealing collar is provided to seal the pump with respect to the container.

13 Claims, 8 Drawing Figures

Fig. 1.
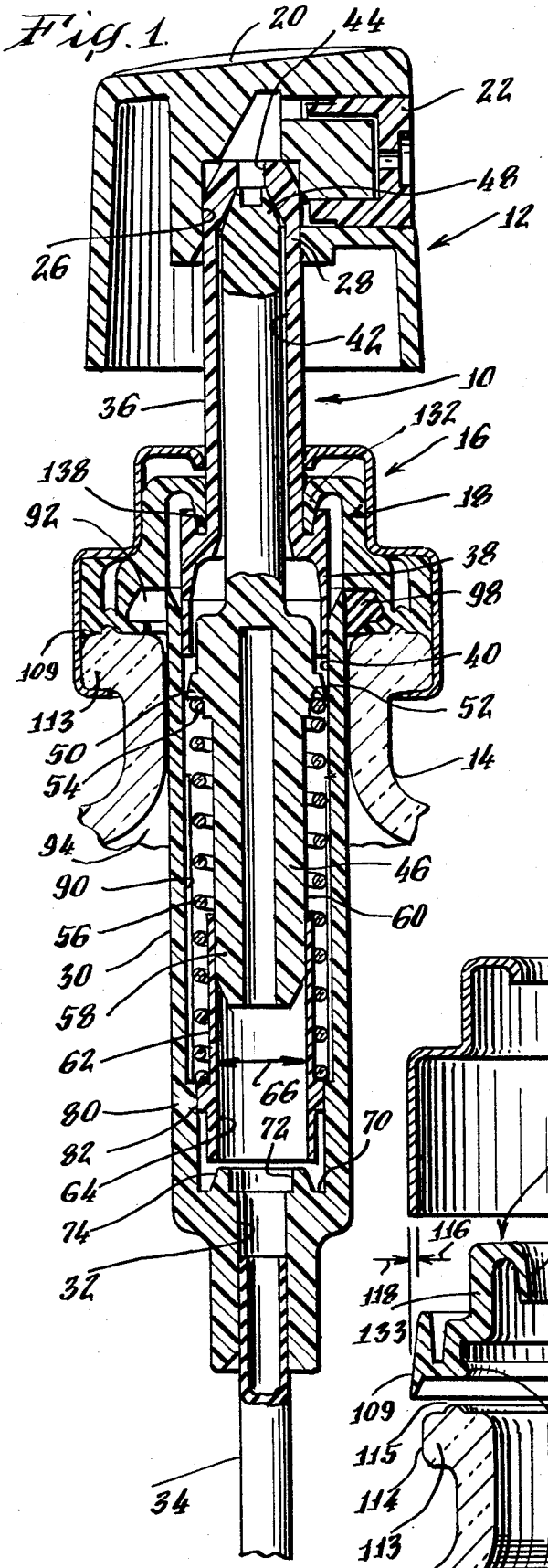
Fig. 2.
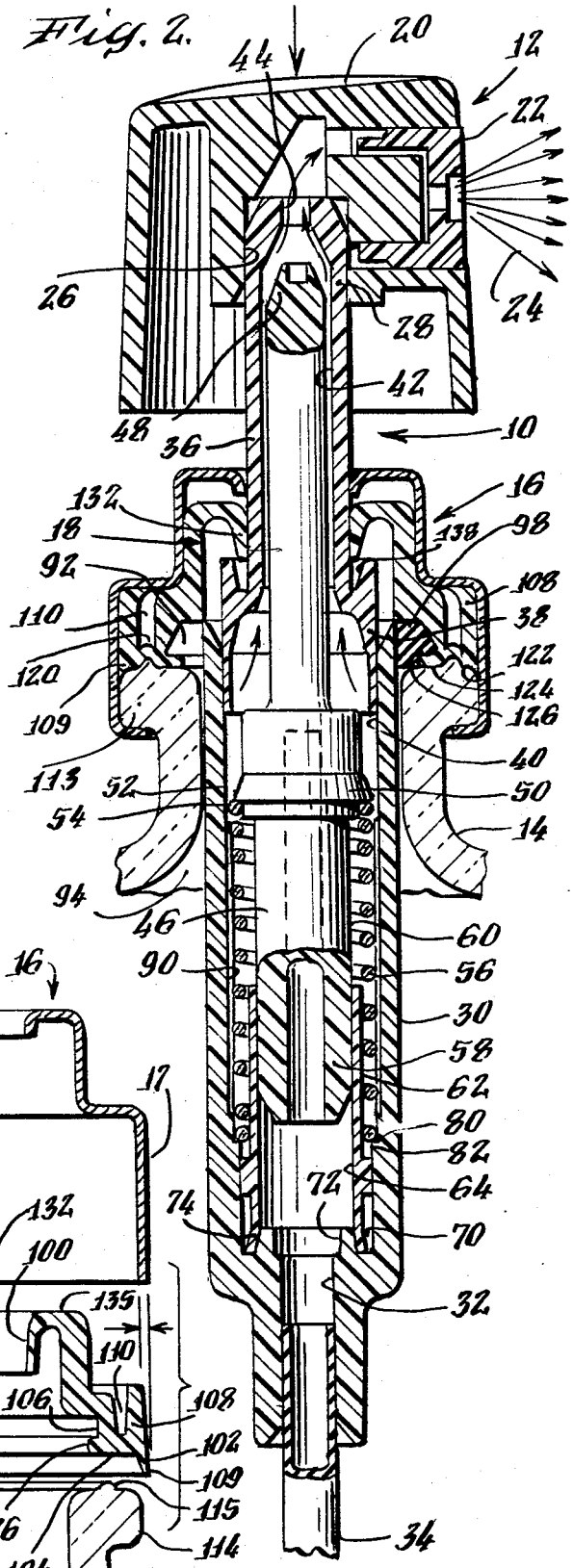
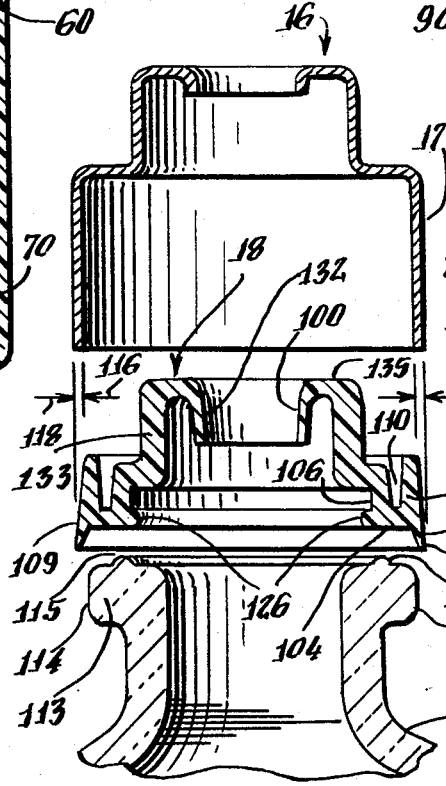
Fig. 5.

PUMP FOR DISPENSING LIQUID FROM A CONTAINER

BACKGROUND OF THE INVENTION (1) Field of the Invention

The present invention relates to manually operated pumps for dispensing liquid from a container. More specifically, the present invention relates to a non-throttling dispensing pump of the type having a manually operated actuator.

(2) Discussion of the Prior Art

A conventional non-throttling pump for dispensing liquid from a container includes a cylinder having an inlet for receiving liquid from the container through a dip tube and a piston slidable reciprocally in the cylinder. The piston has an interior chamber having an opening at one end thereof for dispensing liquid from the chamber. A valve member is positioned in the chamber and has a dispensing valve at one end portion biased toward a position closing the opening of the piston. The valve member is movable under liquid pressure against the bias away from the opening to dispense liquid from the chamber.

Conventional non-throttling and throttling pumps have a ball-type inlet valve for opening and closing the inlet of the cylinder. Although various types of prior art inlet valves have been proposed, a typical inlet valve is a free floating ball which seats on a circular valve seat. During the dispensing stroke of manual operation of the actuator, the ball valve seats to close the chamber during the initial portion of the stroke of the actuator. Because the valve member is biased toward a position closing the dispensing opening of the piston, a chamber is defined, and the chamber decreases in volume as the actuator is pushed downwardly. As pressure builds up in the chamber, the valve member positioned in the chamber is urged downwardly under liquid pressure against its bias to dispense liquid from the chamber.

When the actuator is released and moves upwardly, the ball check valve unseats and liquid is suctioned from the dip tube into the chamber, and the pump is ready for another dispensing stroke.

An inlet valve using a ball-type check valve is disadvantageous for several reasons. During the initial portion of the actuator stroke, and prior to buildup of substantial pressure in the chamber, the check valve is held in a closed position by gravity. In instances where the pump is turned to a position other than vertical, the check valve may not seat during initial portion of the stroke of the actuator, and thus the volume of the liquid dispensed may be decreased and throughout a series of actuations the volume dispensed may be erratic. During filling of the chamber as the actuator is released and moves upwardly, the ball-type check valve tends to inhibit smooth flow of liquid up into the chamber for the next stroke.

Several prior art dispensing pumps have attempted to avoid use of a ball-type check valve. U.S. Pat. No. 4,025,046 to Boris discloses an inlet valve wherein a cylindrical sleeve slides over an elongate tubular projection. However, since the tubular projection is elongate, the cylindrical sleeve, which cooperates with this tubular projection to form a seal, permits inflow of liquid into the dispensing chamber only during a latter portion of the return stroke. The pump may be operated so that full return of the actuator is not permitted. For example, a person may use the pump by pressing the actuator downwardly for a full stroke, and then permit the actuator to rise under its bias to half of the length of its return stroke, which movement is insufficient to open the valve. The person will then push downwardly again expecting further dispensing of liquid. With the device disclosed in the Boris patent, liquid does not flow into the dispensing chamber during the initial portions of the return stroke of the actuator, and thus a person operating the pump in the manner described, will not dispense any liquid.

U.S. Pat. No. 4,212,332 to Kutik et al discloses a manually operated pump wherein the floating valve is slidable with respect to the actuator. The floating valve has a generally cylindrical configuration with inwardly bent fingers at its upper region which frictionally engage the outside of the cylindrical actuator but which permit flow of liquid between the fingers. Each of the fingers is biased to engage the actuator tightly but yield to permit the actuator to slide with respect to the valve when a tapered valve tip on the lower portion of the floating valve seats on a valve seat. With the pump disclosed in the Kutik et al patent, once the tapered tip seats on the valve seat, the liquid pressure inside the floating valve is equal to the liquid pressure on the outside of the floating valve because there are ports permitting fluid communication between both the inside and outside of the valve. Because of this pressure equilibrium, the valve disclosed in Kutik et al patent would not function in a conventional non-throttling pump, wherein a pressure differential is necessary to move the valve member.

Other U.S. patents of interest include U.S. Pat. No. 4,230,242 to Meshberg and U.S. Pat. No. 4,215,805 to Giuffredi.

SUMMARY OF THE INVENTION

A pump in accordance with one aspect of the present invention includes an inlet valve for opening and closing the inlet of the pump. The pump includes a cylinder, a piston having an interior chamber and a valve member positioned in the chamber. The valve member has a dispensing valve at one end portion biased toward a position closing an opening in the upper end of the piston at the top of the chamber. The opposite end of the valve member includes an elongate cylindrical surface that coacts with an inlet valve to provide for sealing of the inlet opening during dispensing and opening of the inlet to allow suctioning of liquid into the dispensing chamber during the return stroke of the actuator.

The inlet valve has a cylindrical surface that has a diameter sized to frictionally engage, provide a liquid seal, and slide with respect to the cylindrical surface of the valve member. The inlet valve moves with the cylindrical portion of the valve member until it is seated on the inlet. Thereafter, the inlet valve slides with respect to the cylindrical end portion of the valve member during further travel of the valve member with respect to the cylinder. The movement of the piston reduces the volume of the dispensing chamber thereby increasing the pressure in the chamber to provide a positive pressure differential between the chamber and the container which holds the liquid. The pressure differential forces the inlet valve against the inlet to seal the chamber with respect to the container. The positive pressure differential provides a tight seal that prevents seepage of liquid back into the liquid container during the dispensing stroke. Because the inlet valve does not work under a gravity principle, the pump may be operated at any angle thereby providing a distinct advantage over conventional ball check valves.

When hand pressure on the actuator is released and the valve member moves upwardly under its bias, the frictional engagement of the valve member with the inlet valve immediately pulls the inlet valve off of its seat thereby permitting suctioning of liquid from the container. Thus, liquid is suctioned from the container during the entire return stroke of the actuator. If a person operating the pump repetitively depresses the actuator without permitting the actuator to return to its uppermost position, the pump will dispense the liquid suctioned during the segment of the return stroke.

In accordance with one aspect of the invention, the inlet valve comprises a generally cylindrical sleeve having a cylindrical surface on its interior. The sleeve has an inner diameter sized to frictionally engage the elongate cylindrical surface of the valve member. The inlet comprises an opening circumferenced by an annular ring protruding upwardly from the floor. The ring has an outer diameter sized to fit within the sleeve. When the cylindrical sleeve seats on the ring and the pressure differential increases, the sleeve is forced radially inwardly against the ring to seal the inlet opening. When the actuator is released, the inlet valve, which is in frictional engagement with the valve member is pulled upwardly by the friction as well as a suction force to immediately open the inlet. The ring surrounding the inlet opening has a relatively small height so that the suctioning of liquid is permitted during the initial portion of the upstroke of the sleeve.

In accordance with another aspect of the invention a sealing collar for use in sealing the pump with respect to the container is provided. A conventional container has a radially protruding flange to which the pump must be attached. In accordance with the present invention, a sealing collar is provided and comprises a resilient body having a central aperture for receiving the pump. The body includes at its periphery a circular sealing ring having a generally U-shaped cross-section. The cross-section has a floor for contacting the container flange, and an inner and outer sidewall having a space therebetween the outer sidewall at the bottom thereof includes a wedge-shaped sealing member which is forced into a space between the container flange and a mounting cup.

The seal collar is installed onto the container flange with the use of a mounting cup having an upper end portion which engages the pump and a lower end portion that is crimped around the bottom lip of the bottle flange. The mounting cup holds the pump in place with respect to the container. When the sealing collar is installed with the use of a mounting cup, the U-shaped ring is compressed radially inwardly and simultaneously pressed downwardly against the flange. The floor of the U-shaped ring is deformed upwardly into the space between the two sidewalls by a circular bead on the upper surface of the flange. At the same time, the sidewalls are urged downwardly so that the floor at two areas contacts the flange of the container. The two circular areas of contact between the sealing collar and the bead provide a double seal. Moreover, the downward pressure of the mounting cup on the outer sidewall of the seal forces a wedge-shaped sealing member into the space between the edge of the flange and the mounting cup thereby providing a tight seal.

In accordance with another aspect of the invention the pump is air tight, that is, the pump is "non-venting". Because the volume of liquid dispensed is not replaced with air, a partial vacuum builds in the container. Through design of the pump components, and use of an inlet valve that does not function on a gravity principal, a pump in accordance with one aspect of the invention will function with a partial vacuum in the container.

Additional advantages of a pump in accordance with the present invention will be apparent from the detailed description of the invention with reference to the drawings.

BRIEF DESCRIPTION OF THE DRAWINGS

FIGS. 1, 2, 3, and 4 are cross-sectional views of a pump in accordance with the present invention in various states of operation;

FIG. 1 shows the pump in its rest position;

FIG. 2 shows the pump in the position wherein liquid is dispensed;

FIG. 3 shows the pump wherein the actuator has been fully depressed;

FIG. 4 shows the pump in a position wherein liquid is being suctioned from the container; and FIG. 5 shows an exploded sectional view of a mounting cup, a sealing collar and the bead of the container which holds the liquid;

DETAILED DESCRIPTION OF THE INVENTION

Figure 3:
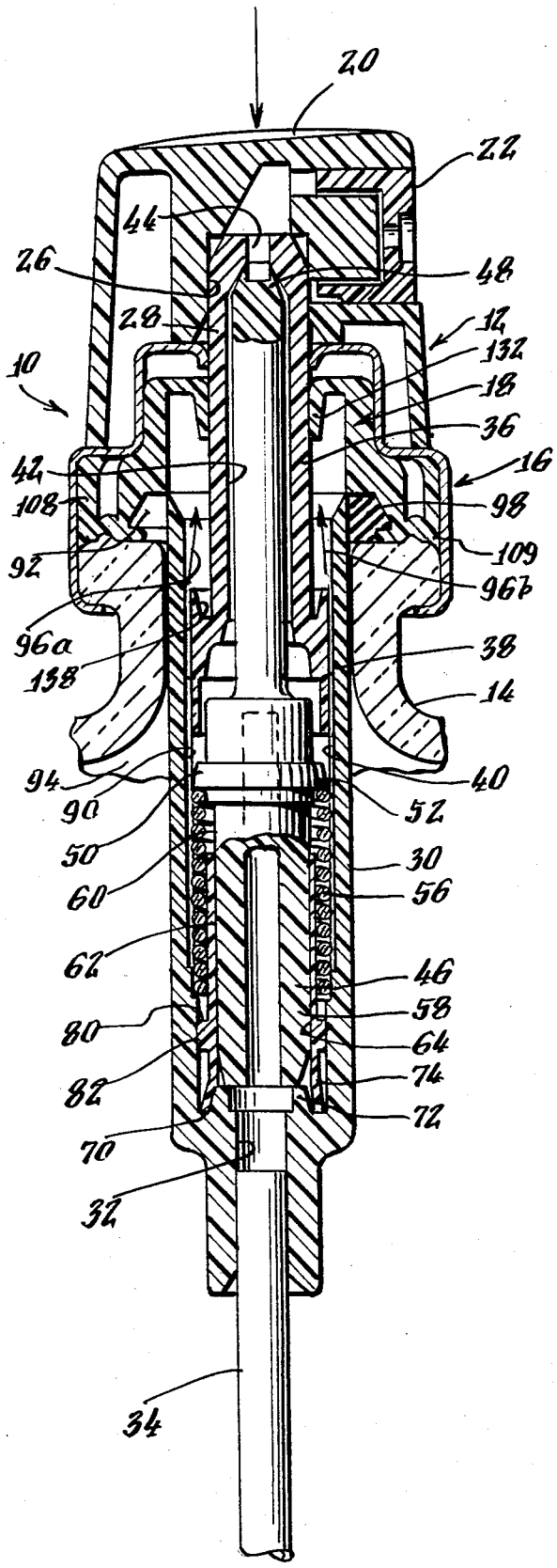

Referring to FIGS. 1 through 7, a pump in accordance with the present invention is shown. FIG. 1 shows a cross-sectional view of the pump in its rest position. The pump 10 has an actuator 12 attached thereto and is secured to a container 14 by the use of a mounting cup 16. A sealing collar 18 seals the pump with respect to the container 14 and with respect to the piston stem 10 to prevent or reduce evaporation of liquid from the container and contamination of the liquid stored in the container by leakage of air into the container.

The actuator 12 includes an upper surface 20 for finger actuation as well as a nozzle 22 to disperse liquid in a fine, aerosol spray as shown at reference character 24 of FIG. 2. The actuator has a cylindrical recess 26 for snugly receiving the upper portion 28 of the pump 10.

The pump 10 will now be described in detail. The pump includes a cylinder 30 having an inlet 32 for receiving liquid from the container 14. The inlet has secured thereto an elongate dip tube 34 which extends to the bottom of the container 14 and functions as a conduit for delivering liquid to the pump. A piston 36 is slidable within cylinder 30. The piston includes a lower skirt 38 having a diameter sized to snugly engage the interior wall 40 of cylinder 30. The piston is slidable reciprocally in the cylinder 30 and has an interior chamber 42 along its length. The piston has an opening 44 at one end thereof for dispensing liquid from the chamber and is slidable through a downward stroke from the position shown in FIG. 1 to the position shown in FIG. 3. When finger pressure is released from the actuator 12, the piston will move under spring bias from the position shown in FIG. 3 to the position shown in FIG. 4.

A valve member 46 is positioned in the chamber 42. The valve member 46 includes a dispensing valve 48 at one end portion biased toward a position closing the opening 44 of the piston. The valve member includes a radial protrusion 50 that defines beneath it an annular recess 52 for receiving the uppermost coil 54 of helical spring 56. The helical spring 56 biases the valve member upwardly toward the position shown in FIG. 1. Because the dispensing valve at the top of the valve member is in contact with the upper portion of the piston, the helical spring also biases the piston to its uppermost position as shown in FIG. 1. The valve member 46 is movable under liquid pressure against the bias of spring 56 away from the discharge opening 44 to dispense liquid from the chamber of the piston. Thus, liquid is dispensed only when there is sufficient pressure build-up to move the valve member 46 against the bias of helical spring 56. As soon as pressure is relieved by the dispensing of liquid, the valve member returns under the force of the helical spring to prevent or minimize drippage of liquid. This type of pressure actuated pump is termed a "non-throttling" pump.

The lower end portion 58 of the valve member, which is also termed a "tail", has an elongate cylindrical surface 60. An inlet valve is provided for closing and opening the inlet 32. The inlet valve 62 includes a cylindrical surface 64 which has a diameter 66 sized to frictionally engage, provide a liquid seal, and slide with respect to the cylindrical surface 60 of the tail 58 of the valve member. The inlet valve 62 comprises a generally cylindrical sleeve having the cylindrical surface 64 on its interior.

The cylinder 30 has a floor 70 adjacent the inlet 32. The inlet opening 32 is circumferenced by an annular ring 72 projecting upwardly from the floor 70. The ring 72 has an outer diameter sized to fit within the sleeve, that is, its diameter permits the sleeve 62 to completely surround the ring as shown in FIG. 2.

In accordance with a preferred aspect of the invention, the ring 72 includes an outer surface 74 tapering inwardly as it extends upwardly from the floor. The outer surface 74 provides a seat upon which the interior cylindrical surface 64 of the sleeve seats to close the inlet. As shown by a comparison between FIGS. 1 and 2, as the sleeve contacts the outer surface 74 of the ring 72 it is deformed slightly radially outwardly thereby providing a tight fit between the sleeve and the outer wall 74 of the ring. It should be noted that the ring 72 is tapered so that when the sleeve is moved upwardly, inflow of liquid through the inlet is permitted as soon as the actuator moves upwardly by release of finger pressure.

The interior cylindrical surface of cylinder 30 includes a stepped portion 80 which retains the end of helical spring 56 between it and the cylindrical sleeve. The spring forms a protrusion at its bottom coil that limits upward travel of the sleeve. The sleeve has an annular stop surface 82 that projects radially outwardly from the outer surface of the sleeve. As the sleeve moves upwardly, this stop surface contacts the end coil of helical spring 56 thereby preventing further upward movement of the sleeve.

The sequential steps of operation of the pump will now be described. When the pump is initially shipped, the interior chamber is filled with air and the pump must be primed. Since the air pressure in the chamber developed by downward movement of the piston is not sufficient to operate the valve member and move it away from the dispensing opening 44, a land surface 90 is provided on the interior surface of the cylinder. As the skirt 38 of the piston moves over the land area 90, an air space is provided which permits air to move past the piston into an empty volume 92 and through a space 94 between the container and the outer wall of cylinder 30 (FIG. 3). The path of the air is shown in FIG. 3 at arrows 96*a* and 96*b*. The space 92 is provided by the absence of annular flange 98 in at least one segment of its arc. More specifically, annular flange 98 extends circumferentially around the top of the cylinder except at one or more points where a gap or space 92 is provided.

Once the pump is primed, the actuator 12 is depressed with respect to the container 14 by finger force on upper surface 20. As shown in the comparison between FIGS. 1 and 2, as the actuator 12 is moved downwardly, the piston is also forced downwardly and slides with respect to cylinder 30. The tail end portion 58 of the valve member moves the sleeve 62 to the position shown in FIG. 2. As the actuator 12 is depressed further, the liquid pressure in the dispensing chamber builds up and forces the sleeve radially inwardly against the ring 72. Further movement of the piston provides sufficient force to overcome the frictinal engagement between the tail 58 of the valve member and the interior cylindrical surface of sleeve 62 so that the tail of the valve member slides with respect to the sleeve from the position shown in FIG. 2 to the position shown in FIG. 3. It is important to note that during the movement of the various components of the pump from the position of FIG. 2 to the position of FIG. 3, the interior pressure $P_1$ inside the cylindrical sleeve is maintained at a pressure substantially equal to that of the head space in the bottle or container 14, while the pressure $P_2$ on the outside of the sleeve 62 increases. Because of this positive pressure differential, the resilient deformable sleeve is pressed tightly against the ring 72 and tail end 58 and seals the chamber 42 with respect to the container 14. Thus, it is important that the cylindrical sleeve be sized to provide a liquid seal between it and the tail of the valve body so that the pressure inside the sleeve is maintained at the pressure of the container and liquid is prevented from flowing back into the container. The maintainence of the low pressure inside the cylindrical sleeve also permits the valve member 46 to slide with respect to the sleeve 62 due to the pressure differential between the chamber and inside the sleeve 62.

Once the dispensing stroke of the actuator has been completed as shown in FIG. 3, and finger pressure is released from the actuator, spring 56 forces the piston and the valve body upwardly. Referring in particular to FIG. 3, it is noted that the lower end of sleeve 62 is in contact with outer surface 74 of the ring 72. As soon as the actuator is released, the sleeve is pulled upwardly by the valve element 46 and away from the ring 72 thus permitting suctioning of liquid as shown at arrows 98 in FIG. 4. It can be appreciated that since the movement of sleeve 62 is independent of gravity, the pump may be operated at various angles other than vertical and the sleeve properly functions to seal. This is not the case with a conventional ball-type check valve.

As the sleeve moves upwardly, the stop surface 82 contacts the lowermost coil of helical spring 56 and is prevented from further upward movement. This stop surface maintains the sleeve in close proximity to the ring 72 so that when the actuator is depressed again, immediate sealing takes place.

Preferably, the pump is operated in such a manner that the actuator and the internal components move through a full stroke to the position shown in FIG. 3. However, persons may actutate the pump by moving the actuator through only a portion of the stroke. With a pump in accordance with the present invention, as soon as downward travel of the actuator begins the sleeve seals the interior chamber with respect to the container thus permitting dispensing upon buildup of pressure. As soon as the actuator begins to move upwardly, the sleeve moves away from the ring, and liquid is permitted to be suctioned into the dispensing chamber. Thus, even if the pump is actuated improperly through only a portion of its stroke, dispensing still occurs.

Referring to FIG. 5, a sealing collar in accordance with the present invention will now be described. The sealing collar 18 comprises a resilient body made of polyethylene or other resilient material. The collar has a central aperture 100 for receiving the piston 10 of the pump. The collar at its periphery includes a circular sealing ring 102 having a generally U-shaped cross-section. The ring has a floor 104, an inner sidewall 106 and an outer sidewall 108. The sidewalls 106 and 108 have a space 110 therebetween for accomodating the bead 115 on the upper surface 112 of the flange 114 when the pump is assembled. The bead 115 protrudes upwardly from the upper surface 112 of the flange 114 and extends in a circle around the flange.

The annular outer sidewall 108 includes at the bottom thereof a sealing member 109 that has a wedge-shaped cross-section. This sealing member extends around the entire periphery of the sealing collar. The wedge-shaped sealing member 109, as will be described hereinafter, is driven into a space between the mounting cup 16 and the rounded flange of the bottle to provide a liquid and air-tight seal between the sealing collar and the bottle flange.

As shown in FIG. 5, the mounting cup wall 17 has an inner diameter 116 which is smaller than the outer diameter 118 of the outer sidewall of the U-shaped ring. Also, as shown in FIGS. 2 and 5, the height of the outer sidewall 108 is sized so that it is compressed axially when the mounting cup 16 is attached to the container flange 114. As shown in the drawings, the mounting cup 16 is crimped onto the bottle flange. However, it should be understood that other manners of securement may be used, such as a threaded mounting cup which is screwed to a threaded bottle flange.

Referring to FIG. 2, the sealing collar 18 is shown assembed with the other components of the pump. As the mounting cup 16 is crimped over the lower lip 113 of flange 114, the outer sidewall 108 is compressed axially so that the wedge-shaped seal 109 is forced downwardly into the space between the rounded segment of the flange 114 and the interior surface of wall 17 of mounting cup 16. This wedge-shaped seal 109 provides a liquid and airtight seal between the flange 114 of the bottle and the sealing collar. In addition, when assembly occurs, bead 115 is forced upwardly into floor 104 of the sealing collar and as shown in a comparison between FIGS. 2 and 5, deforms the floor upwardly into space 110. This second deformation provides an additional seal to prevent liquid and air leakage.

A rim 126 extends radially inwardly from the inner sidewall 106 of the U-shaped ring. A radially projecting flange 98 of the cylinder 30 fits over the rim 126 and holds the rim in contact with the container flange 114. Also, the inner sidewall 106 is compressed and forced radially downwardly to urge the floor 104 into contact with the upper surface of flange 114. Since both sidewalls 106 and 108 are axially compressed and forced downwardly against the upper surface of flange 114, a seal having two discrete areas of contact is provided and produces an effective liquid and air seal.

Figure 4:
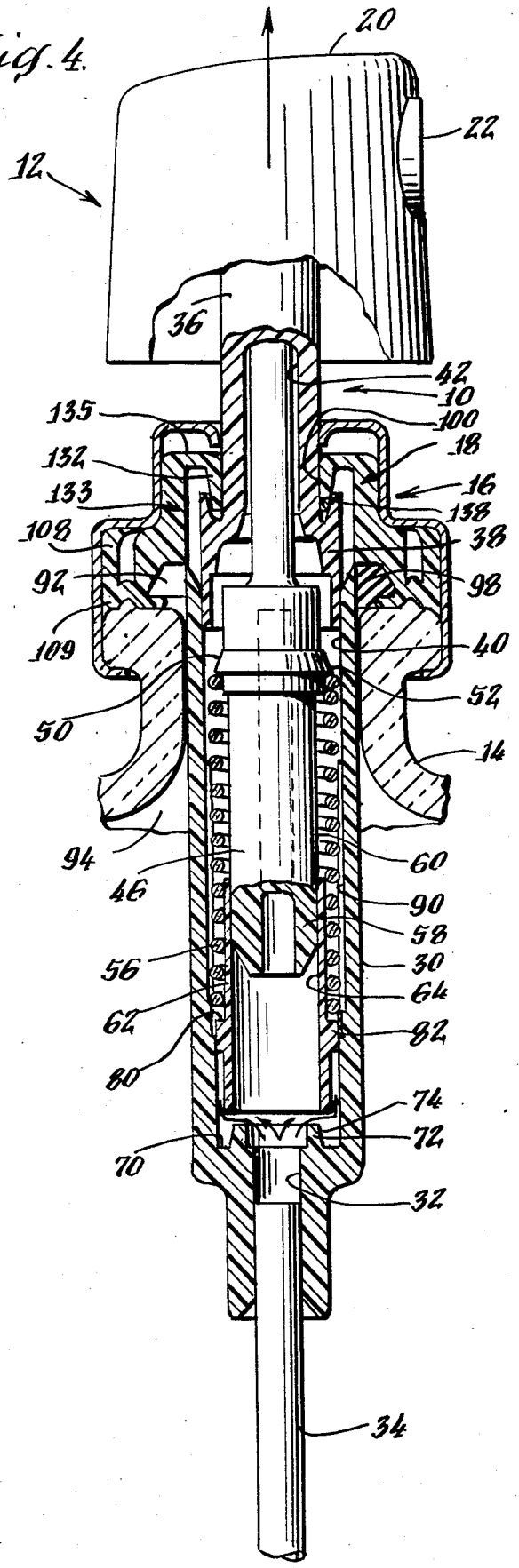
Figure 6:
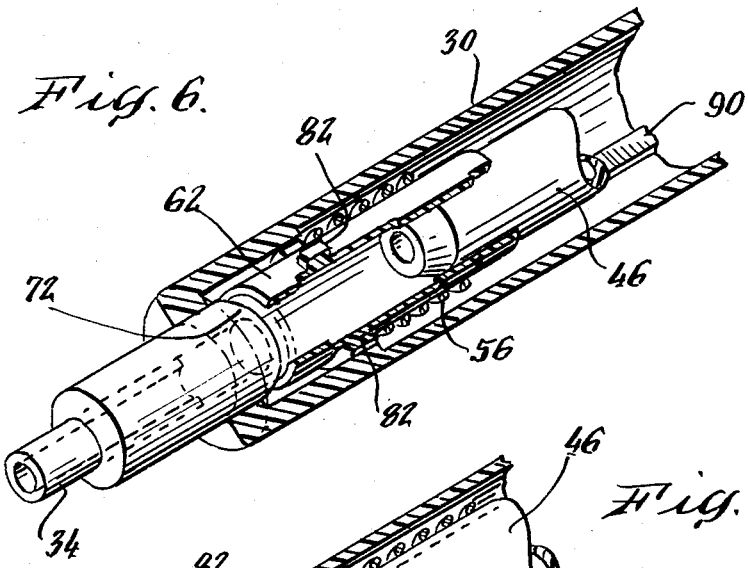
FIG. 6 shows a perspective view, partially sectioned away, of the pump shown in FIGS. 1–5 in the position of FIG. 4.
Figure 7:
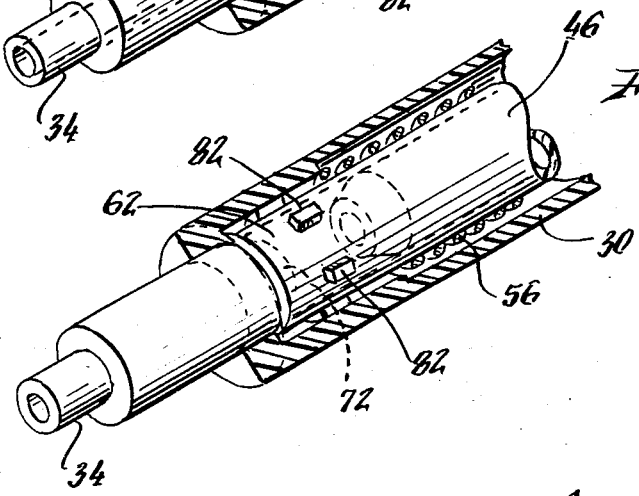
FIG. 7 shows a perspective view, partially sectioned away, of the pump shown in FIGS. 1–5 in the position of FIG. 2.

In accordance with one aspect of the invention, the pump is non-venting. As shown in FIG. 4, the central aperture 100 of the sealing collar 18 includes a sleeve 132 which projects downwardly and radially inwardly so that when the piston is positioned in opening 100, the sleeve is deformed slightly and contacts the piston about its circumference. The sleeve remains in contact with the piston throughout pump actuation so that it precludes or minimizes the incursion of air into the container. The sleeve also acts as a wiper to eliminate or minimize the escape of liquid from the container. As shown in FIGS. 1 and 2, the piston includes an annular groove 138 into which the sleeve 132 seats when the pump is in a rest position. The seating of the sleeve in the annular groove 138 prevents incursion of air into the container when the dispensing device is stored over prolonged periods of time. Sleeve 132 is preferably integrally formed with ceiling collar 18 and, as shown in FIG. 4, is supported on a vertical post 133 that has an annular shape. A radially extending bridge 135 secures sleeve 132 to the vertical annular post 133. Since the sealing collar 18 is made of a resilient plastic material and sleeve 132 has a relatively small thickness, the sleeve 132 remains flexible during pump actuation. As shown in FIG. 5, the sleeve 132 has a frustoconical shape before the piston is inserted into opening 100. When the piston is inserted, as shown in FIG. 4, the sleeve 132 is deformed slightly radially outwardly and is in contact with the surface of the piston.

In a conventional pump, a vent is provided to permit entry of air into the container to replace the liquid displaced from the container. A conventional pump provides a vent so that a vacuum will not build up in the container, but is disadvantageous in that liquid may leak through the vent. In accordance with one aspect of the invention, the pump is non-venting and a build up of a partial vacuum in a container is permissible. The advantage of a vacuum in the container is that the amount of air in contact with the liquid is reduced and leakage of liquid will not occur. Liquids which are readily oxidized or deteriorate in air may be stored over a relatively longer period of time. For example, in the case of perfumes, it is desirable to prevent oxidation of the liquid which may alter the fragrance of the perfume. The partial vacuum occurs as liquid is dispensed.

A non-venting pump in accordance with the present invention can be actuated with a vacuum in the container because the diameter of the stem 28 of the piston 36 is of reduced size thereby minimizing the force of the vacuum on the piston. A pump in accordance with the present invention may have a relatively small diameter piston stem 28. If a piston stem having a large diameter stem is used with a non-venting pump wherein a vacuum occurs in the container, the forces on the piston may be such that a stronger helical spring is required, thus requiring excessive finger pressure for actuation.

It is desirable to keep the spring force under two pounds. Thus, in prior art pumps, a vent was provided so that a vacuum would not occur and the size of the spring could be reduced. In the design of the present pump, by selecting a piston stem having a relatively small diameter the pump will function with a vacuum in the container because the force of the spring bias overcomes the force of the partial vacuum on the piston.

Figure 8:
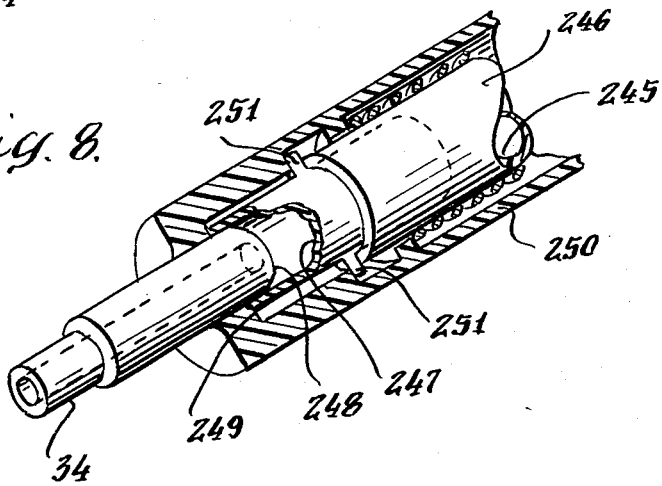
FIG. 8 is a perspective view, partially sectioned away, of an alternative embodiment of a pump in accordance with the present invention.

Referring to FIG. 8, an alternative embodiment of an inlet valve is disclosed. The upper portion of the pump remains as described with respect to FIGS. 1–7. However, the inlet valve has been modified so that the cylindrical sleeve slides within the tail of the valve member rather than outside the tail of the valve member. Valve member 246 includes an elongate cylindrical hollow portion 245 which receives cylindrical sleeve 247. The outer diameter of sleeve 247 is sized to fit tightly within the inner diameter of valve member 246 and annular ring 248 extends upwardly from the floor 249 of the cylinder 250. The sleeve 247 includes stop surfaces 251 which functions in a manner similar to stop surfaces 82, and limits the upward travel of the cylindrical sleeve.

A pump in accordance with the present invention has a reduced number of components in that a complicated non-throttling mechanism has been eliminated and this function is combined with the inlet check valve. Also, if desired, the entire pump may be constructed of nonrubber materials, which in conventional pumps tend to contaminate the product being dispensed.

In summary, a pump in accordance with the present invention is particularly advantageous in that it may be operated in various positions, and the check valve does not depend upon gravity for operation. The pressure build up in the dispensing chamber forces the inlet valve against its seat thereby making a firm, liquid tight seal during the dispensing stroke.

As soon as finger pressure on the actuator is released, the piston, the valve member, and the inlet valve sleeve move upwardly under spring bias. The sleeve immediately unseats from its seat thus permitting immediate suctioning of liquid into the chamber.

In accordance with another aspect of the invention, the pump is attached to the flange of a conventional container with the use of a unique sealing collar having a wedge-shaped sealing member which is forced into a space between the mounting cup and the rounded flange of the bottle to provide an effective seal.

It should be understood that although specific embodiments of the invention have been described herein in detail, such description is for purposes of illustration only and modifications may be made thereto by those skilled in the art within the scope of the invention.

I claim:

1. A non-throttling pump for dispensing liquid from a container comprising:

a cylinder having an inlet for receiving liquid from said container:

a piston slidable reciprocally in said cylinder, said piston having a interior chamber along its length and having an opening at one end thereof for dispensing liquid from said chamber, said piston being slidable against a bias through a downward stroke and with said bias through an upward stroke;

a valve member positioned in said chamber and having a dispensing valve at one end portion biased toward a position closing said opening, said valve member moveable under liquid pressure against said bias away from said opening to dispense liquid from said chamber, said valve member having a second end portion having a cylindrical surface;

an inlet valve for opening and closing said inlet of said cylinder, said inlet valve including a cylindrical surface having a diameter sized to frictionally engage, provide a liquid seal, and slide with respect to said cylindrical surface of said valve member, said inlet valve moving with said second end portion of said valve member until seated on and prevented from further movement with respect to said inlet, said inlet valve sliding with respect to said valve member end portion and moving with respect to said piston during further travel of said valve member with respect to said cylinder, said movement of said piston reducing the volume of said chamber thereby increasing pressure in said chamber to provide a positive pressure differential between said chamber and said container, said inlet valve moving with said valve member and away from said inlet and opening said inlet during an initial portion of said upward stroke of said piston to open said inlet and suction liquid during substantially the entire upward stroke of said piston.

2. A pump according to claim 1 wherein said inlet valve comprises a cylindrical sleeve having said cylindrical surface on its interior, said sleeve having an inner diameter sized to frictionally engage said cylindrical surface of said valve member.

3. A pump according to claim 1 wherein said inlet valve comprises a cylindrical sleeve having said cylindrical surface on its exterior, said sleeve having an outer diameter sized to frictionally engage said cylindrical surface of said valve member.

4. A pump according to claim 2 wherein said cylinder has a floor adjacent said inlet, said inlet comprising an opening circumferenced by an annular ring projecting upwardly from said floor, said ring having an outer diameter sized to fit within said sleeve, said pressure differential during operation of said pump forcing said sleeve radially inwardly against said annular ring to seal said inlet opening.

5. A pump according to claim 4 wherein said annular ring includes an outer surface, said outer surface tapering inwardly as it extends upwardly from said floor, said outer surface providing a seat upon which said interior cylindrical surface of said sleeve seats to close said inlet.

6. A pump according to claim 5 and further including means limiting travel of said sleeve between said closed position and an open position.

7. A pump according to claim 6 wherein said travel limiting means comprises a protrusion extending radially outwardly from said sleeve, and a stop secured with respect to said cylinder for engaging said protrusion to limit upward travel of said sleeve.

8. A pump according to claim 7 wherein said annular ring has a height less than one half the length of said downward stroke and said frictional engagement between said valve member and said sleeve provides for upward movement of said sleeve as said piston is biased and moves upwardly during said initial portion of said upward stroke to permit filling of said chamber during substantially the entire upstroke of said piston.

9. A pump according to claim 5 wherein said sleeve comprises a resilient deformable material, said inner diameter of said sleeve being smaller than the outer diameter of said annular ring at said floor and being larger than the outer diameter of said annular ring at the top thereof, said sleeve during pump actuation moving downwardly and seating on said annular ring at a position intermediate with said top and said floor, said sleeve being deformed radially outwardly by said ring and providing liquid-tight seal with respect to said ring.

10. A pump according to claim 1 wherein said piston includes an annular skirt, said skirt contacting and providing a seal with said cylinder, said piston being moveable through a stroke having an end portion, said cylinder including means for deforming said skirt during said end portion of said stroke to break said seal and permit passage of air.

11. A non-throttling and non-venting pump for dispensing liquid from a container in which a partial vacuum builds as the liquid is dispensed comprising:

a cylinder having an inlet for receiving liquid from said container:

sealing means between said cylinder and said container for providing a substantially airtight and liquid tight seal during operation of said pump;

a piston slidable reciprocally in said cylinder, said piston having a interior chamber along its length and having an opening at one end thereof for dispensing liquid from said chamber, said piston being slidable against a spring bias through a downward stroke and with said bias through an upward stroke;

sealing means between said piston and said cylinder for providing a substantially airtight and liquid tight seal during operation of said pump and permitting said piston to slide with respect to said cylinder;

a valve member positioned in said chamber and having a dispensing valve at one end portion biased by said spring bias toward a position closing said opening, said valve member moveable under liquid pressure against said spring bias away from said opening to dispense liquid from said chamber.

an inlet valve for opening and closing said inlet of said cylinder;

said piston being sized so that a force of the partial vacuum thereon is overcome by a force provided by said spring bias.

12. A pump according to claim 11 wherein said cylinder and container sealing means comprises a resilient sealing collar having a central aperture for slidably receiving said piston, said collar having a frustoconical sleeve projecting downwardly and radia11y inwardly of said aperture, said piston having a cylindrical outer surface engaging and deforming said frustoconical sleeve to provide a cylindrical area of contact between said sleeve and said piston during pump actuation.

13. A pump for dispensing liquid from a container comprising:

a cylinder having a floor at one end, said floor having therein an inlet for receiving liquid from said container:

a piston slidable reciprocally in said cylinder, said piston having a interior chamber along its length and having an opening at one end thereof for dispensing liquid from said chamber, said piston being slidable against a bias through a downward stroke and with said bias through an upward stroke;

a valve member positioned in said chamber and having a dispensing valve at one end portion biased toward a position closing said opening, said valve member moveable under liquid pressure against said bias away from said opening to dispense liquid from said chamber, said valve member having a second end portion having a surface;

an inlet valve for opening and closing said inlet of said cylinder comprising a sleeve, said sleeve including a surface sized to frictionally engage, provide a liquid seal, and slide with respect to said surface of said valve member, said inlet valve moving with said second end portion of said valve member until seated on the floor of said cylinder, said inlet valve sliding with respect to said valve member end portion and being maintained stationary with respect to said cylinder floor during further travel of said valve member, toward said cylinder floor, said movement of said piston reducing the volume of said chamber thereby increasing pressure in said chamber to provide a positive pressure differential between said chamber and said container, said inlet valve moving with said valve member and away from said floor during an initial portion of said upward stroke of said piston to open said inlet and section liquid during substantially the entire upward stroke of said piston; and means for limiting travel of said inlet valve with respect to said cylinder subsequent to said initial portion of said upward stroke, said inlet valve sliding with respect to said valve member end portion during further travel of said valve member in said upward stroke to maintain said inlet valve in close proximity to said inlet thereby permitting substantially immediate sealing during said downward stroke.

* * * * *